US005197204A

United States Patent [19]

Christensen

[11] Patent Number: 5,197,204

[45] Date of Patent: Mar. 30, 1993

[54] ROTARY DRYER AND ASSOCIATED DRYING PLANT

[75] Inventor: Jørgen S. Christensen, Farum, Denmark

[73] Assignee: Atlas Industries A/S, Ballerup, Denmark

[21] Appl. No.: 681,521

[22] PCT Filed: Oct. 19, 1989

[86] PCT No.: PCT/DK89/00246

§ 371 Date: May 10, 1991

§ 102(e) Date: May 10, 1991

[87] PCT Pub. No.: WO90/05272

PCT Pub. Date: May 17, 1990

[30] Foreign Application Priority Data

Nov. 10, 1988 [DK] Denmark ..... 6288/88

[51] Int. Cl.[5] ..... F26B 11/02

[52] U.S. Cl. ..... 34/135; 34/136; 34/137

[58] Field of Search ..... 34/179, 180, 135, 108; 432/103, 118

[56] References Cited

U.S. PATENT DOCUMENTS

| | | |
|---|---|---|
| 3,720,004 | 3/1973 | Okawara . |
| 3,950,861 | 4/1976 | Weimer et al. . |
| 4,711,041 | 12/1987 | Ullum . |
| 4,727,658 | 3/1988 | Ullum . |

FOREIGN PATENT DOCUMENTS

| | | |
|---|---|---|
| 1246588 | 8/1967 | Fed. Rep. of Germany . |
| 1804154 | 12/1976 | Fed. Rep. of Germany . |
| 224903 | 4/1969 | Sweden . |
| 1463688 | 2/1977 | United Kingdom . |

*Primary Examiner*—Henry A. Bennet

*Attorney, Agent, or Firm*—Antonelli, Terry, Stout & Kraus

[57] ABSTRACT

A rotary dryer (1) for the drying of, for example, biological sludge, comprises a rotatable drum having rake elements (6) with openings for the passage of sludge disposed on the inner side of the drum casing.

A drying plant with such a dryer further comprises a hot-gas plant (3) and one or more co-rotating drying zones (4,5).

8 Claims, 4 Drawing Sheets

ROTARY DRYER AND ASSOCIATED DRYING PLANT

FIELD OF THE INVENTION

The present invention relates to a rotary dryer for drying of hydrous masses.

BACKGROUND OF THE INVENTION

Rotary dryers for drying of hydrous masses such as, for example, biological sludge have been proposed with the rotary dryer including an elongated rotatable drum having a drum casing, on an inner side of which are disposed a plurality of radially disposed vane elements which extend into an interior of the drum. The vane elements are arranged to lift the sludge when the drum is rotated, and at least some of the vane elements comprise a rake element including a number of ribs in a radial direction and bridge-like connecting elements, preferably, parallel to the axis of the drum. The connecting elements connect the free ends of the ribs to form openings.

Rotary dryers of the aforementioned type are used for drying many different types of hydrous masses such as, for example, biological sludge or comminuted masses of organic or biological materials, the water contents of which must be removed by drying.

In order to reduce the consumption of energy in the drying of the hydrous masses, a mechanical drying is often first carried out, with such mechanical drying being effected, for example, by the use of a press, prior to establishing a thermal drying. With mechanical drying of, for example, biological sludge, the water content can only be reduced to around 65–85%, so that there still is a very high content of water to be dried off.

By drying the sludge to a completely dry granulate, a stable and odorless biological inactive material is obtained which can be used as a fertilizer or soil improvement agent.

If, for example, the biological sludge is dried to a water content of less than 10%, preferably around 5%, the dried sludge is combustible with a calorific value of approximately 2500–3500 kcal/kg., and can thus be used as fuel, for example, in connection with the generation of thermal energy for the drying process.

U.S. Pat. No. 3,950,861 proposes a rotary dryer for drying of, for example, biological sludge, by a rotating drying drum which is equipped with lifting vanes which bring the sludge into better contact with the hot drying gas. In the configuration of the lifting vanes, special regard is paid to preventing the sludge from packing tightly on or around the vanes.

However, biological sludge from cleaning plants, which is more or less dried mechanically, has the very unfortunate characteristic that apparently a firm presscake becomes deliquescent and sticky (tixotropic) when worked mechanically and will, for example, in a plant such as disclosed in U.S. Pat. No. 3,950,861, be kneaded into large clumps which are unstable for a rotational drying. In order to avoid this, material, which has already been dried, is mixed back in, so that from the start, the sludge is not tixotropic, but substantially fluid, otherwise one must introduce mechanical breaking elements which separate the large clumps to form smaller clumps in a manner described, for example, in U.S. Pat. No. 3,720,004 or DE-B-1,246,588.

In this connection, DE-B-1,246,588 proposes a rotating dryer for coal sludge. The drum has movable vane elements, with one side of the vane elements being hinged to an inner surface of the drum. The freely swinging ends of the vane elements will, in connection with violent strokes and loud noise, destroy the packed drying materials. The hinges are in the hot drying gas and will be destroyed by the heat and due to the wear from the drying materials.

The above noted known proposals have a number of disadvantages in that the mixing-back results in reduced capacity, increased energy consumption, complicated control, etc., and, in that the introduction of mechanical breaking elements results, among other things, in a complicated and expensive construction with high energy consumption and high maintenance costs.

SUMMARY OF THE INVENTION

The aim underlying the present invention essentially resides in providing a rotary dryer into which hydrous masses can be introduced and dried, for example, predried biological sludge, and in which the sludge can be dried down to a granulate with the desired water content without the above noted disadvantages inherent in such plants.

In accordance with advantageous features of the present invention, the vane elements are passive elements and the ribs are constructed as thin rods preferably with a round cross-sectional profile. The connecting elements are configured with lifting surfaces and openings in adjacent vane elements are offset from one another in a direction of rotation.

By virtue of the above noted features of the present invention and, in particular, the disposition of the openings in the vane elements, the openings constantly separate the sticky tixotropic mass into smaller clumps, which are dried by the hot through-flowing drying gas. The size of the openings determines the maximum size of the individual clumps which can be formed thereby achieving a well-defined clump formation during the initial drying.

The rake elements thus simultaneously comprise the stirring elements, lifting elements and breaking elements, and it should be noted that this is achieved without the use of independent mechanical moving parts in that the passive rake elements are secured on the inner wall of the drum casing and follow the drum casing around the rotation of the drum.

The dryer according to the present invention is a very simple mechanical construction which is both inexpensive to produce and inexpensive to mount inside the drum, and there is no risk of the sticky material being able to pack firmly around the ribs and thereby block the openings in the vane elements. A clump which has just capable of passing through an opening in a rake element will, by virtue of the rotation of the drum, meet a rib at the next rake element, and the clump will be instantly divided or crushed. With a rotary dryer of this type, the material to be dried is broken down into a granulate.

Additionally, in accordance with the present invention, the offsets arise from the ribs in adjacent vane elements and are offset from one another. By virtue of this feature, a very efficient breakdown of the sludge into smaller clumps is possible, which clumps are lifted up inside the drying drum and flushed by the drying gas.

In order to provide a very simple mechanical construction which is both inexpensive to produce and inexpensive to mount inside the drum of the dryer, in accordance with the present invention, the vane elements are configured with substantially planar lifting surfaces.

Moreover, to reduce the risk of sticky material being packed firmly around the ribs and thereby blocking the openings of the vane elements, each vane element is composed of more than one rake element in the radial direction.

In accordance with still further features of the present invention, the total area of the openings in the vane elements constitute 60–90% of the total area of the vane elements, as viewed in a direction of rotation.

The invention also relates to the use of a rotary dryer with the above described vane elements, with the dryer being disposed in a drying plant for drying sticky tixotropic hydro masses such as, for example, biological sludge, with the plant including a non-rotating hot gas plant arranged in front of the dryer and one or more co-rotating post-drying zones in an elongated rotatable drum arranged after the drier and in which there are disposed lifting vanes on an inner side of the drum and, possibly, auxiliary elements to increase the fall time of the dried sludge. A first post drying zone comprises radial ribs and longitudinal lifting vanes parallel to the axis of rotation. The last drying zone comprises lifting vanes configured as back-feeding vanes which are also disposed on the inner side of the rotatable drum.

The plant for use of the dryer constructed in accordance with the present invention can be arranged in such a manner that it is normally never necessary to stop the drying plant as a consequence of an over accumulation or clumping together of the material to be dried, even if the material is sticky, tixotropic sludge. With such a drying plant, a sludge, which has been predried mechanically with, for example, 20% dry stuff content, can be dried down to a granulate with a dry stuff content of 95% and substantially energy neutral, in that the dried granulate in comminuted condition, contains sufficient thermal energy upon combustion to provide the amount of hot gas or air necessary to dry the sludge.

The above and other objects, features, and advantages of the present invention will become more apparent from the following description when taken in connection with the accompanying drawings which show, for the purpose of illustration only, several embodiments in accordance with the present invention.

DETAILED DESCRIPTION

Figure 1:
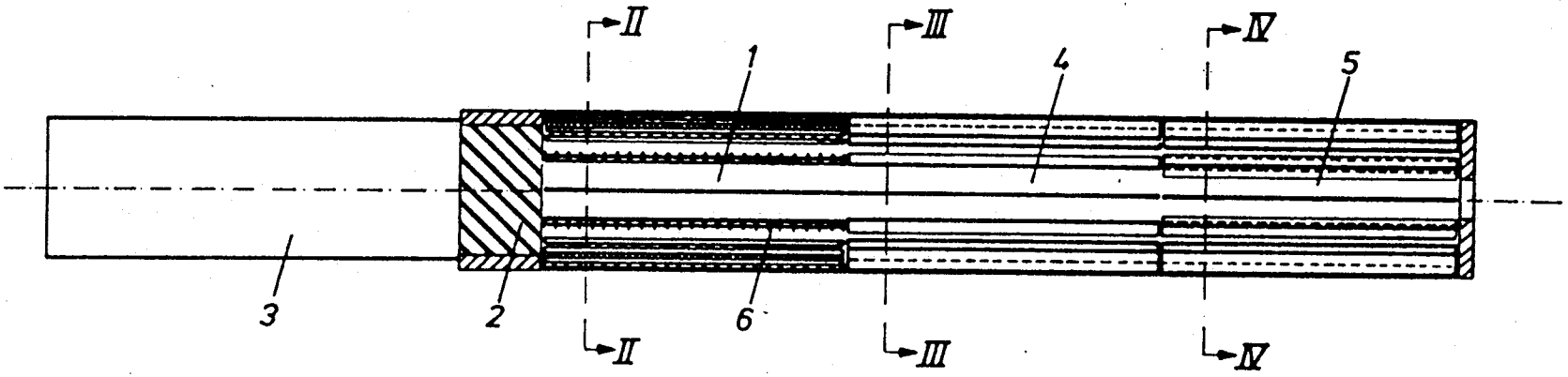
FIG. 1 is an axial partial cross-sectional view of a drying plant constructed in accordance with the present invention with a rotary dryer.

Referring now to the drawings wherein like reference numerals are used throughout the various views to designate like parts and, more particularly, to FIG. 1, according to this figure, in accordance with the present invention, a drying plant includes a rotary drum dryer 1 having an inlet end 2 with inclined feeding vanes so that a press-cake introduced does not accumulate but is immediately conveyed into the interior of the dryer. A drying gas plant 3, for example, an oven for the combustion of dry, pulverized sludge or other waste is disposed in front of the dryer, with blower elements being provided so that the hot drying gas or air is fed to the rotary dryer 1. Alternatively, fuel such as oil or natural gas may be used. The oven 3 will normally be non-rotating and can be of any known kind. In the direction of flow after to rotary dryer, there are two co-rotating zones 4, 5 with zone 4 being an intermediate zone and zone 5 being an accumulation zone in which the final drying is effected before the granulated material leaves the plant.

The driving elements, rollers, motors etc. for the rotating parts of the drying plant are not shown in FIG. 1 of the drawing and can be of any conventional construction.

In the interior of the dryer 1, a number of vane elements 6 are provided on the inner side of the casing. The vane elements provide the desired effect and are therefore described in more detail in connection with FIGS. 2 and 5–7.

Figure 2:
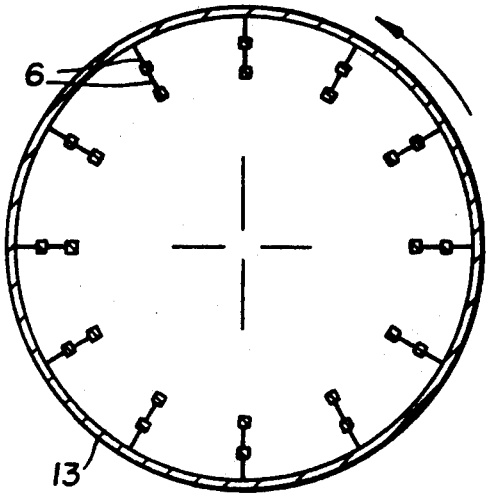
FIG. 2 is a sectional view taken along the lines II—II in FIG. 1.
Figure 5:
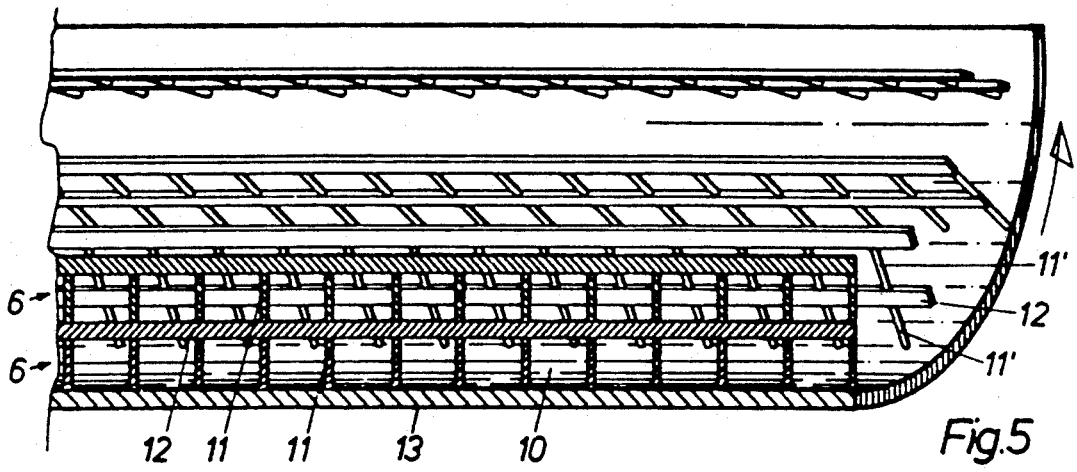
FIG. 5 is a partial cross-sectional view of a dryer with rake elements in accordance with a first embodiment of the present invention.

As shown in FIGS. 2 and 5, the vane elements 6, which are welded to an inner side of the drum casing 13, are configured as one or more "rakes" or rake elements 6, built up of ribs 11, with the free ends of the ribs 11 being connected to bridge-like connecting elements 12. The ribs 11 can be formed from round rods or tubes, for example, with a diameter of 10 mm, and the connecting elements 12 can be made of 10×20 mm flat bars as shown. Thus, the connecting elements 12 form a kind of lifting vane with the ribs 11, with a number of intermediate openings 10 disposed in one or more rows.

As shown in FIG. 5, the rake elements 6, which are arranged successively in the direction of rotation, are offset from one another in such a manner that the ribs 11 are, for example, disposed oppositely center of the openings 10 in the adjacent rake elements, as viewed in a direction of rotation.

The individual rake elements 6 can be disposed on the drum casing 13 at regular intervals, and a tooth depth of each rake element 6 may be around 60 mm, while the distance between the ribs 11 can be around 100 mm. Whether there should be more than one rake element disposed in a radial direction, as shown in FIG. 5, will depend upon the diameter of the drum, the desired degree of filling and on the material to be dried. The extent of the rake elements in the axial direction from the inlet through the dryer must be of a sufficient length so that the material to be dried is no longer exteriorly sticky but has at least a thin dry shell surface when it leaves this zone and moves over the intermediate zone 4.

Figure 6A:
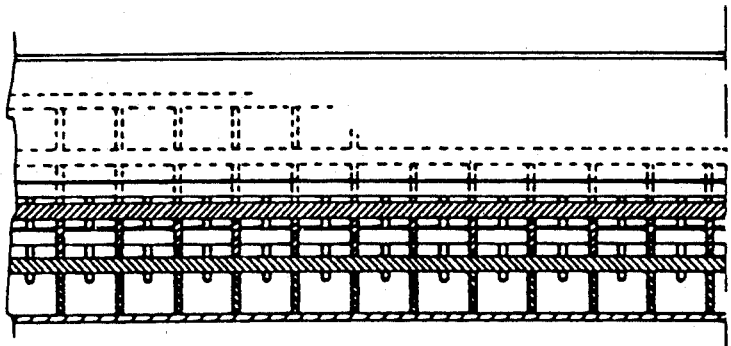
FIGS. 6*a* and 6*b* are a cross-sectional views of rake elements in accordance with a second embodiment of the present invention.
Figure 6B:
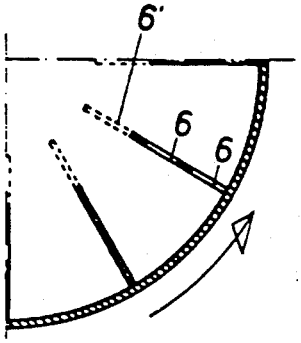

In FIGS. 6*a* and 6*b*, a third row of rake elements 6′ is shown with stippled lines in that the most central rake element 6′ is shown in this manner, while the two rows at the casing are shown with solid lines. For other applications, it will be sufficient for each lifting vane to comprise only one rake element 6.

Figure 7A:
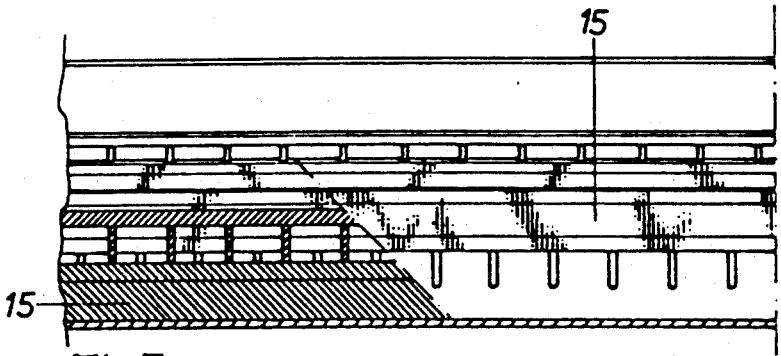
FIGS. 7*a* and 7*b* are cross-sectional views of a dryer with rake elements constructed in accordance with a third embodiment of the present invention.
Figure 7B:
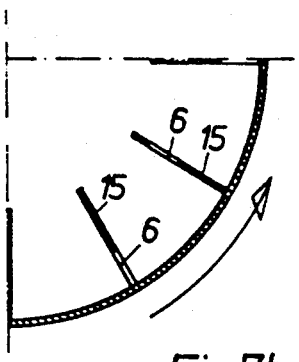

FIGS. 7*a* and 7*b* show another embodiment of the rake elements 6, in which these are augmented with lifting vanes 15 which can be disposed either at the drum casing 13 or on a part facing inwardly toward the axis of rotation.

As apparent to the skilled artisan, the rake elements 6, 6′, 15 can be configured in many different manners, and such different configurations can be combined without deviating from the basic idea of the present invention. Moreover, a more detailed configuration of the rake elements can be determined by the length and diameter of the dryer, the type material to be dried, and on a degree of hydrousity. Normally, the total area of the openings in the vane elements must be around 60–90% of the total area of the vane elements.

Figure 3:
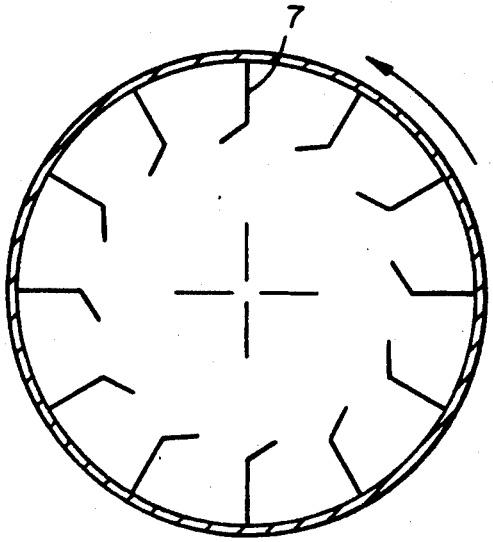
FIG. 3 is a sectional view taken along the line III—III in an intermediate drying zone of the dryer of FIG. 1.
Figure 4A:
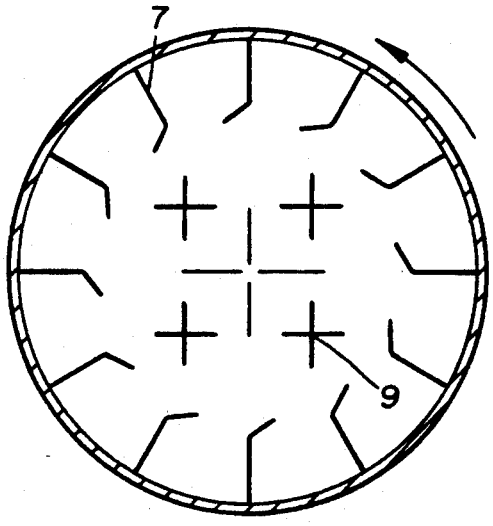
FIGS. 4*a* and 4*b* are sectional views taken along the line IV—IV of two embodiments of an accumulation zone in the drying plant of FIG. 1.
Figure 4B:
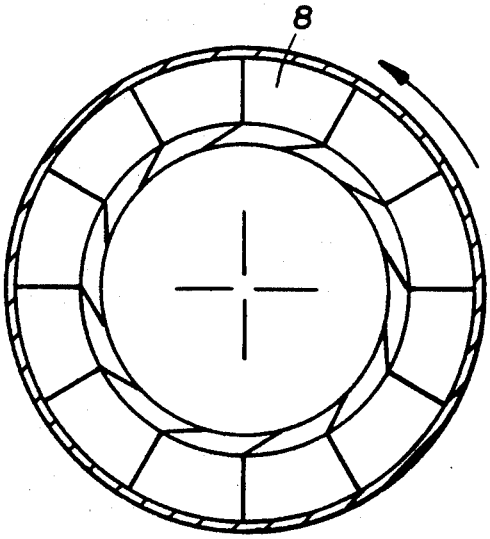

FIGS. 3 and 4 illustrate sections in those zones of the drying plant which lie after the rotary drier 1. Usually, intermediate zone 4 will be provided with normal longitudinally lifting vanes 7 (FIG. 3), and corresponding lifting vanes 7 (FIG. 4*a*) or rearward-leading lifting vanes (FIG. 4*b*) can be provided in the final drying zone 5, depending on how high the degree of accumulation of the material there is need for in this zone. The final zone 5 can also be provided with auxiliary elements 9 (FIG. 4*a*) in the form of longitudinal cross members, which cross members increase the fall time of the now flowable substantially dry sludge so that the time for which the sludge is in contact with the drying air is increased.

Figure 8:
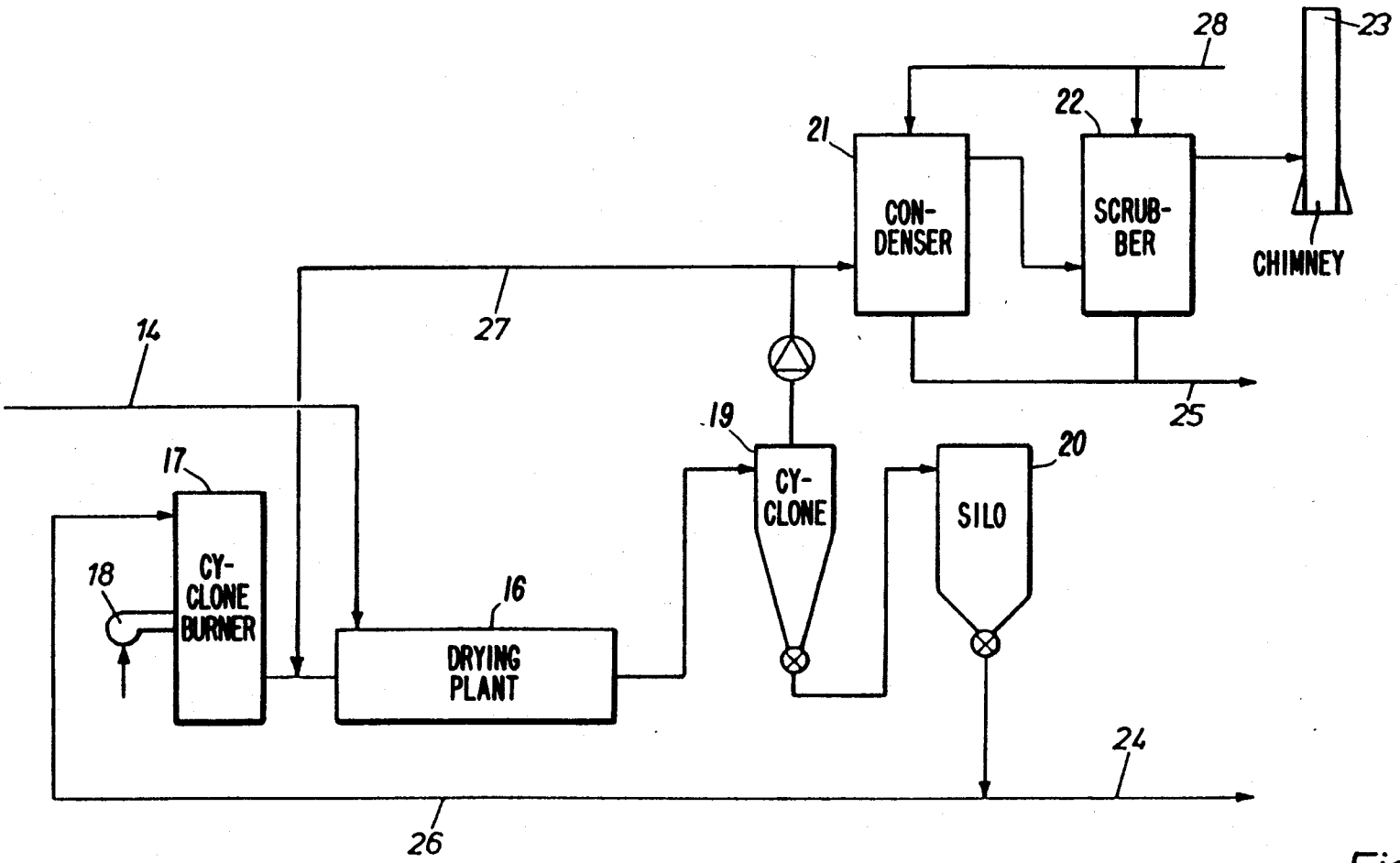
FIG. 8 is a schematic view of a complete drying plant for a drying of drained sludge.

FIG. 8 schematically depicts a system for the drying process for drying of drained biological sludge. Mechanically drained sludge with a dry stuff content of around 15–35% is fed into a drying plant 16 by a conveyor 14, with the drying plant being of the type illustrated in FIG. 1. The dried product is conveyed to a cyclone 19, where the drying gases are separated from the dried product. From the cyclone 19, the dried product is conveyed to a silo 20 from which the dried product can be transported by a conveying means 24 or carried by a conveyor 26 to a cyclone burner 17, which for start-up or alternative operation can be provided with an oil or a gas burner 18. The hot drying gas from a cyclone 19 is fed, as required, through a pipe 27 either to the cyclone burner or oven 17 or direct to the drying plant 16. The residual thermal energy in the drying ga is hereby reused. Surplus drying gas is condensed and cleaned in a condenser 21 and a scrubber 22, which is provided with water through a pipe 28, and from where the waste water 25 is carried to a waste-water plant. Instead of the water scrubber, a biological filter of a conventional type can be used, such as, for example, a so-called compost filter, in that the need for water is hereby considerably reduced. The cleaned air is lead to the chimney 23. If the drained sludge, supplied to the drying plant 16 has a reasonable calorific value, which, for example, is the case with dried sludge, such a drying process using a drying plant 16 with a rotary drier according to the present invention without feed-back of the materials will function in a substantially energy-neutral manner, in that energy in the form of oil or gas needs only to be supplied during a start-up of a plant.

I claim:

1. A rotary dryer for drying hydrous masses, the rotary dryer comprising an elongated rotatable drum with a drum casing;

a plurality of radially disposed vane elements arranged on an inner side of said drum casing and extending into an interior of the drum casing, said elements being arranged to lift the hydrous mass when the drum is rotated, at least some of the vane elements are fashioned as rake elements including a plurality of ribs extending in a radial direction and at least one bridge-like connecting element extending substantially parallel to a longitudinal axis of the drum, said at least one connecting element connecting free ends of the ribs to form openings, wherein the ribs are fashioned as rods having a round cross-sectional profile, said at least one connecting element is fashioned as a flat bar, and said openings and ribs in adjacent vane elements are offset from one another in a direction of rotation of the rotatable drum.

2. A rotary dryer according to claim 1, wherein the vane elements are provided with substantially planar lifting surfaces.

3. A rotary dryer according to one of claims 1 or 2, wherein each vane element includes more than one rake element extending in a radial direction of the drum casing.

4. A rotary dryer according to one of claims 1 or 2, wherein a total area of the openings in the vane elements constitutes 60–90% of a total area of the valve elements, as viewed in a direction of rotation of the rotatable drum.

5. A rotary dryer according to one of claims 1 or 2, wherein the hydrous mass is biological sludge.

6. A rotary dryer according to one of claims 1 or 2, wherein a plurality of connecting elements are provided for connecting the free ends of the ribs to form said openings.

7. The drying plant according to claim 6, wherein the sticky tixotropic hydrous mass is biological sludge.

8. A drying plant for drying sticky tixotropic hydrous masses, the drying plant comprising:

a rotary dryer including a rotatable drum with a drum casing, a plurality of radially disposed vane elements arranged on an inner side of said drum casing and extending into an interior of the drum, said elements being arranged to lift the hydrous masses when the drum is rotated, at least some of the vane elements are fashioned as rake elements including a plurality of ribs extending in a radial direction and at least one bridge-like connecting element extending substantially parallel to a longitudinal axis of the drum, said at least one connecting element connecting free ends of the ribs to form openings, the ribs are fashioned as rods having a round cross-sectional profile, the at least one connecting element is fashioned as a flat bar, and said openings and ribs in adjacent vane elements are offset from one another in a direction of rotation of the rotatable drum, wherein a non-rotating hot-gas plane is arranged forwardly of the dryer, and wherein at least one co-rotating post-drying zone is provided in the elongated rotatable drum, said at least one post-drying zone being disposed downstream of the dryer, and wherein the vane elements are lifting vanes and at least some of said vane elements, at least in a drying zone of the rotary dryer are configured as back-feeding vanes disposed on the inner side of the drum casing.

* * * * *